US007331916B2

(12) United States Patent
Fox

(10) Patent No.: US 7,331,916 B2
(45) Date of Patent: Feb. 19, 2008

(54) CASE FORMER WITH PIVOTAL ENGAGEMENT ROLLER ASSEMBLIES

(75) Inventor: Bryce J. Fox, Honesdale, PA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/588,257

(22) Filed: Oct. 27, 2006

(65) Prior Publication Data

US 2007/0042886 A1 Feb. 22, 2007

Related U.S. Application Data

(63) Continuation of application No. 11/115,200, filed on Apr. 27, 2005, now abandoned.

(51) Int. Cl.
*B31B 1/28* (2006.01)

(52) U.S. Cl. ..... 493/162; 493/163; 493/183; 53/564; 53/575

(58) Field of Classification Search ..... 493/68, 493/70, 79, 80, 162, 163, 175, 183, 181; 53/563, 564, 566, 575, 382.2, 390, 392, 376.4, 53/377.3, 381.1

See application file for complete search history.

(56) References Cited

U.S. PATENT DOCUMENTS

| | | | |
|---|---|---|---|
| 2,634,566 | A | 4/1953 | Ohrn |
| 3,358,567 | A | 12/1967 | Tucker et al. |
| 4,117,646 | A | 10/1978 | James et al. |
| 4,215,522 | A | 8/1980 | Clift et al. |
| 4,522,016 | A | 6/1985 | DiRico |
| 4,545,175 | A | 10/1985 | Beckett |
| 4,584,818 | A | 4/1986 | Plaskett |
| 4,627,217 | A | 12/1986 | Plaskett |
| 4,627,830 | A | 12/1986 | Smidt |
| 4,656,810 | A | 4/1987 | Plaskett |
| 4,750,317 | A | 6/1988 | Vrana |
| 4,936,816 | A | 6/1990 | Blumle et al. |

(Continued)

FOREIGN PATENT DOCUMENTS

| | | |
|---|---|---|
| FR | 2697497 | 5/1994 |

(Continued)

*Primary Examiner*—Hemant M. Desai
(74) *Attorney, Agent, or Firm*—Schwartz & Weinrieb

(57) ABSTRACT

A new and improved case former, or carton folding and erecting apparatus, is disclosed wherein a pair of pivotal support arms, upon each one of which is mounted a case or carton engagement roller, are mounted upon the machine framework such that when actuator mechanisms, for folding the oppositely disposed major side bottom flap members of the case or carton to their folded positions so as to complete the formation of the bottom portion of the case or carton, are actuated, the pair of pivotal support arms are effectively released from a restrained position, at which case or carton engagement rollers are disposed at retracted positions with respect to the case or carton blank so as to initially permit the case or carton blank to be inserted into the case former, or carton folding and erecting apparatus, in an unobstructed manner, whereby the case or carton engagement rollers can now engage the major side walls of the case or carton so as to retain the case or carton in position while the case or carton is subsequently filled with product.

20 Claims, 3 Drawing Sheets

U.S. PATENT DOCUMENTS

| | | | |
|---|---|---|---|
| 5,102,382 | A | 4/1992 | Center et al. |
| 5,120,293 | A | 6/1992 | Franklin |
| 5,234,398 | A | 8/1993 | Larsen |
| 5,352,178 | A | 10/1994 | Pazdernik |
| 5,415,613 | A | 5/1995 | McGrath |
| 5,445,590 | A | 8/1995 | Pazdernik |
| 5,454,776 | A | 10/1995 | Ulrich et al. |
| 5,826,408 | A | 10/1998 | Ford |
| 5,868,308 | A | 2/1999 | Briand |
| 5,876,319 | A | 3/1999 | Holton |
| 5,897,480 | A | 4/1999 | Pazdernik |
| 5,924,968 | A | 7/1999 | Odenthal |
| 6,309,335 | B1 | 10/2001 | Holton |
| 6,599,225 | B2 | 7/2003 | Ammons et al. |
| 6,622,461 | B2 | 9/2003 | Gambetti |
| 6,669,616 | B1 | 12/2003 | Bierenacki et al. |
| 6,764,436 | B1 | 7/2004 | Mazurek |

FOREIGN PATENT DOCUMENTS

| | | |
|---|---|---|
| FR | 2827259 | 1/2003 |

CASE FORMER WITH PIVOTAL ENGAGEMENT ROLLER ASSEMBLIES

This patent application is a Continuation patent application of prior U.S. patent application Ser. No. 11/115,200, which was filed on Apr. 27, 2005 now abandoned.

FIELD OF THE INVENTION

The present invention relates generally to case formers, or carton folding and erecting apparatus, and more particularly to a new and improved case former, or carton folding and erecting apparatus, wherein a pair of pivotal support arms, upon each one of which is mounted a case or carton engagement roller, are mounted upon the machine framework such that when actuator mechanisms, for folding the oppositely disposed major side bottom flap members of the case or carton to their folded positions so as to complete the formation of the bottom portion of the case or carton, are actuated, the pair of pivotal support arms are effectively released from a restrained position, at which the case or carton engagement rollers are disposed at retracted positions with respect to the case or carton blank so as to initially permit the case or carton blank to be inserted into the case former, or carton folding and erecting apparatus, in an unobstructed manner, whereby the case or carton engagement rollers can now engage the major side walls of the case or carton so as to retain the case or carton in position while the case or carton is subsequently filled with product. Upon completion of the case or carton filling process, the case or carton can be discharged from the machine so as to be conducted into a case sealer machine.

BACKGROUND OF THE INVENTION

Case or carton forming or erecting machines exist wherein an operator initially manually expands a flattened carton blank into an open or expanded carton blank such that the open or expanded carton blank comprises two oppositely disposed minor end walls and two oppositely disposed major side walls, and wherein further, a pair of oppositely disposed minor end wall top flaps and a pair of oppositely disposed major side wall top flaps extend vertically upwardly, while a pair of oppositely disposed minor end wall bottom flaps and a pair of oppositely disposed major side wall bottom flaps extend vertically downwardly. Subsequently, the operator inserts the opened or expanded carton blank into the case or carton former or erector, and as the opened or expanded carton blank is lowered into the case or carton forming or erecting machine, switch mechanisms are activated such that when the opened or expanded carton blank is fully inserted into the case or carton forming or erecting machine, a bottom flap folding sequence is initiated whereby, for example, the pair of oppositely disposed minor end wall bottom flaps are first folded upwardly and inwardly, by means of a first pair of oppositely disposed actuators, so as to partially form the bottom wall portion of the case or carton, and subsequently, the pair of oppositely disposed major side wall bottom flaps are folded upwardly and inwardly, by means of a second pair of oppositely disposed actuators, so as to effectively complete the formation of the bottom wall portion of the case or carton.

It is noted, however, that the pair of oppositely disposed folded minor end wall bottom flaps and the pair of oppositely disposed folded major side wall bottom flaps exhibit a predetermined amount of resiliency or memory which tends to want to cause such oppositely disposed minor end wall bottom flaps and such oppositely disposed major side wall bottom flaps to return to their previously opened or expanded states or positions at which the oppositely disposed minor end wall bottom flaps and the oppositely disposed major side wall bottom flaps will once again extend vertically downwardly, as opposed to remaining in their currently folded states or positions at which the pair of oppositely disposed minor end wall bottom flaps and the pair of oppositely disposed major side wall bottom flaps form the bottom wall portion of the case or carton. However, since the oppositely disposed folded minor end wall bottom flaps and the oppositely disposed folded major side wall bottom flaps are disposed in contact with the first and second pairs of oppositely disposed actuators, the oppositely disposed folded minor end wall bottom flaps and the oppositely disposed folded major side wall bottom flaps cannot actually pivot downwardly and outwardly so as to return to their original opened or expanded positions. Accordingly, the resiliency or memory forces inherent within the oppositely disposed folded minor end wall bottom flaps and the oppositely disposed folded major side wall bottom flaps act upon the first and second pairs of oppositely disposed actuators and tend to cause the case or carton to move vertically upwardly against and away from the first and second pairs of oppositely disposed actuators, thereby undoing or reversing the previously achieved folding of the oppositely disposed folded minor end wall bottom flaps and the oppositely disposed folded major side wall bottom flaps, and the consequent formation of the case or carton bottom wall portion, unless the operator manually pushes downwardly upon the case or carton so as to effectively hold the same in contact with the underlying first and second pairs of oppositely disposed actuators. This is not actually practical, however, because once the case or carton has had its oppositely disposed folded minor end wall bottom flaps and its oppositely disposed folded major side wall bottom flaps folded upwardly and inwardly in order to form the bottom wall portion of the case or carton, the case or carton is then ready to be filled with product, and in order to manipulate the product filling apparatus, the operator cannot maintain his downward force upon the case or carton. Therefore, for example, an additional operator is required to perform the filling of the case or carton with the designated product while the original operator maintains the case or carton in its original position upon the underlying first and second pairs of oppositely disposed actuators.

A solution to the aforenoted problem has been previously developed whereby a pair of oppositely disposed engagement rollers are fixedly disposed upon opposite interior side portions of the case or carton forming or erecting machine such that when the opened or expanded case or carton blank is initially inserted into the machine, the exterior surface portions of the oppositely disposed major side walls of the case or carton blank will engage the fixed engagement rollers with a predetermined amount of contact force or friction. Accordingly, it can be readily envisioned that when the oppositely disposed minor end wall bottom flaps and the oppositely disposed major side wall bottom flaps are folded upwardly and inwardly so as to form the bottom wall portion of the case or carton, the aforenoted predetermined contact force or friction, developed or generated between the exterior surface portions of the oppositely disposed major side walls of the case or carton and the fixed engagement rollers, will in fact restrain the case or carton against undergoing any upward or vertical movement so as to maintain the case or carton at its position upon the first and second pairs of oppositely disposed actuators whereby the product filling operation can then commence.

The problem with this system, however, is that the fixedly mounted engagement rollers must be disposed at a predetermined distance from or relative to each other which is less than the width of the opened or expanded case or carton blank such that the aforenoted degree of contact force or friction, developed or generated between the exterior surface portions of the oppositely disposed major side walls of the case or carton and the fixed engagement rollers, will be sufficient so as to in fact be capable of restraining the case or carton against undergoing any upward or vertical movement. This relative disposition of the fixed engagement rollers, however, has rendered the insertion of the opened or expanded case or carton, into the case or carton forming or erecting machine, quite difficult and tedious leading to decreased production and increased operator fatigue.

A need therefore exists in the art for a new and improved case or carton forming or erecting machine which can in fact easily accommodate the insertion of the opened or expanded case or carton blank into the case or carton forming machine, and which can likewise additionally automatically retain the opened or expanded case or carton at its position, at which the oppositely disposed minor end bottom flaps and the oppositely disposed major side bottom flaps have been folded upwardly and inwardly, without any forces being required to be impressed upon the opened or expanded case or carton by operator personnel.

SUMMARY OF THE INVENTION

The foregoing and other objectives are achieved in accordance with the teachings and principles of the present invention through the provision of a new and improved case or carton forming or erecting machine which comprises a first pair of oppositely disposed actuators for folding the pair of oppositely disposed minor end wall bottom flaps upwardly and inwardly so as to partially form the bottom wall portion of the case or carton, and a second pair of oppositely disposed actuators for folding the pair of oppositely disposed major side wall bottom flaps upwardly and inwardly so as to complete the formation of the bottom wall portion of the case or carton. A pair of oppositely disposed engagement rollers are respectively mounted upon first end portions of a pair of oppositely disposed support arms which are pivotally mounted upon oppositely disposed upper framework members which partially form oppositely disposed sides of the case or carton forming or erecting machine. Spring biasing means are respectively operatively associated with first end portions of the support arms so as to normally bias the engagement rollers to their extended positions at which they can engage the oppositely disposed side walls of the case or carton, and a bumper member is disposed upon second end portions of the support arms, wherein further, the support arms are pivotally mounted at substantially central portions thereof.

Piston-cylinder assemblies are used to pivotally move the second pair of oppositely disposed actuators, for folding the pair of oppositely disposed major side wall bottom flaps, between first retracted positions, at which the second pair of oppositely disposed actuators do not engage and fold the pair of oppositely disposed major side wall bottom flaps, and second extended positions at which the second pair of oppositely disposed actuators do engage and fold the pair of oppositely disposed major side wall bottom flaps upwardly and inwardly so as to complete the formation of the bottom wall portion of the case or carton. When the second pair of oppositely disposed actuators are disposed at their first retracted positions, the piston-cylinder assemblies contact the bumper members of the engagement roller support arms so as to cause the support arms to be pivoted against the biasing forces of the spring means whereby the engagement rollers will be disposed at retracted positions so as to permit the opened or expanded case or carton blank to be inserted into the case or carton forming machine. Conversely, when the second pair of oppositely disposed actuators are disposed at their second ex-tended positions, the piston-cylinder assemblies will be removed from contact with the bumper members of the engagement roller support arms so as to permit the spring biasing means of the roller support arms to cause the support arms to be pivoted whereby the engagement rollers will be biased into engagement with the exterior surface portions of the oppositely disposed major side wall portions of the opened or expanded case or carton so as to fixedly retain the case or carton at its position within the case or carton forming or erecting machine in preparation for commencement of the product filling operation.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
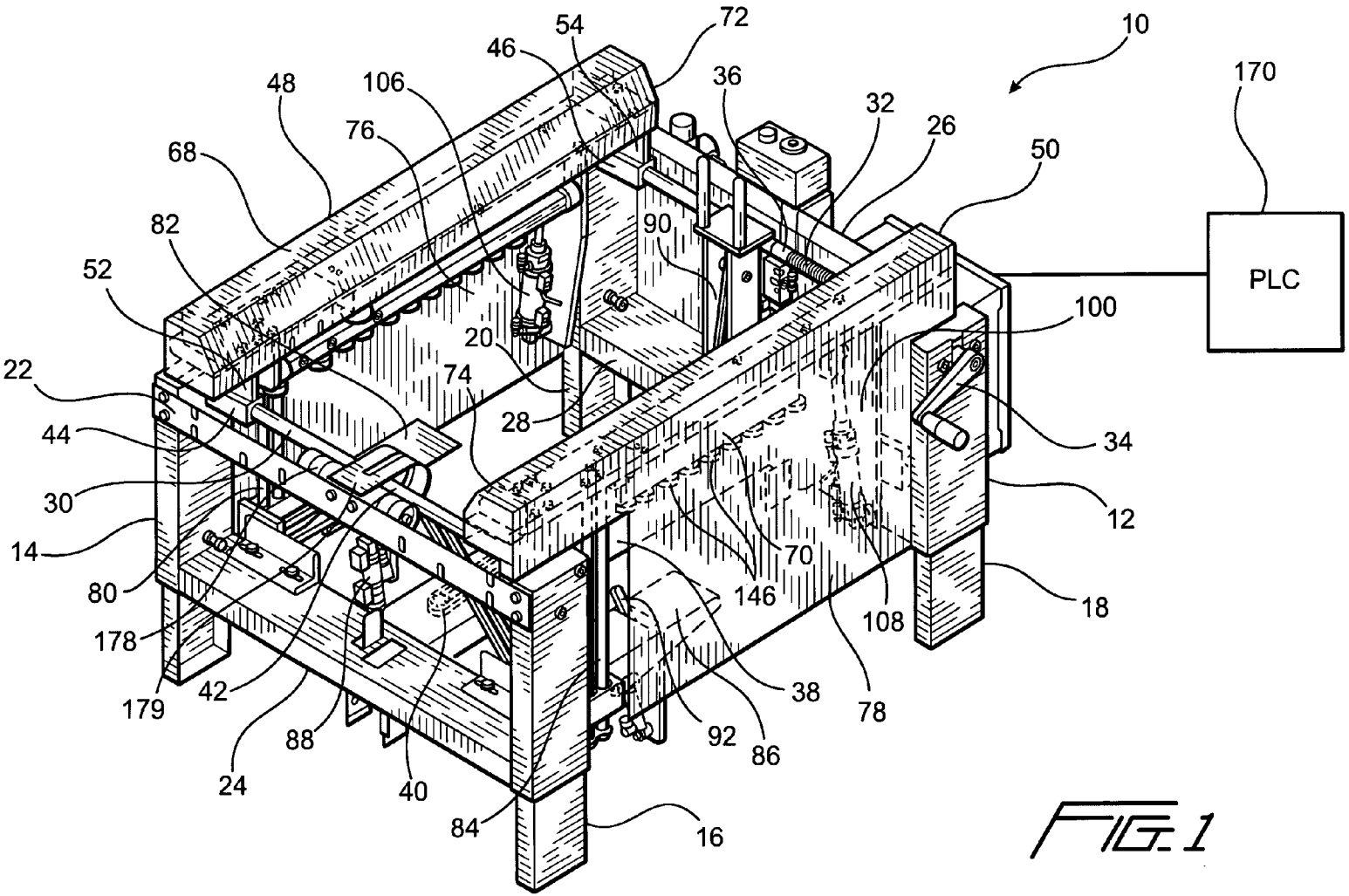
FIG. 1 is a perspective view of a new and improved case or carton forming or erecting machine as constructed in accordance with the principles and teachings of the present invention and showing the cooperative parts thereof.

Referring now to the drawings, and more particularly to FIG. 1 thereof, a new and improved case or carton forming or erecting machine, constructed in accordance with the principles and teachings of the present invention and showing the cooperative parts thereof, is disclosed and is generally indicated by the reference character 10. More particularly, it is seen that the new and improved case or carton forming or erecting machine 10 comprises a primary framework 12 which comprises a plurality of upstanding leg members 14,16,18,20, which are disposed within and define the corner regions of the primary framework 12, and first and second upper and lower transversely oriented cross-brace members 22,24 which rigidly interconnect the leg members 14,16, while third and fourth upper and lower transversely oriented cross-brace members 26,28 which rigidly interconnect the leg members 18, 20. In addition, opposite ends of a first transversely oriented threaded rod 30 are rotatably mounted upon upper end portions of the leg members 14,16 of the primary framework 12, while opposite ends of a second transversely oriented threaded rod 32 are rotatably mounted upon upper end portions of the leg members 18,20 of the primary framework 12. The second transversely oriented threaded rod 32 is operatively connected to a hand-crank mechanism 34 which is rotatably mounted upon the upper external surface portion of the primary framework leg member 18, and a chain drive mechanism, not shown, is adapted to be rotatably routed around an axially central, non-threaded portion 36 of the second transversely oriented threaded rod 32, through a longitudinally extending structural beam member 38, which fixedly interconnects the lower transversely oriented cross-brace members 24,28 of the primary framework 12 and which houses chain drive sprocket wheels 40, and around an axially central, non-threaded portion 42 of the first transversely oriented threaded rod 30.

In this manner, when the hand-crank mechanism 34 is rotated by means of an operator, the second transversely oriented threaded rod 32 is correspondingly rotated, and the rotary motion of the second transversely oriented threaded rod 32 is able to be transmitted to the first transversely oriented threaded rod 30 by means of the chain drive mechanism, not shown. It is noted that the opposite end portions of each one of the transversely oriented threaded rods 30,32, which are respectively disposed upon opposite sides of the central non-threaded portions 42,36 of the transversely oriented threaded rods 30,32, comprise oppositely oriented threads, and a pair of nut members, only one of which is visible in FIG. 1 as at 44, are threadedly engaged upon the opposite end portions of the first transversely oriented threaded rod 30, while in a similar manner, a pair of nut members, only one of which is visible in FIG. 1 as at 46, are threadedly engaged upon the opposite end portions of the second transversely oriented threaded rod 32. The nut members 44,46 are adapted to fixedly mount thereon a pair of oppositely disposed secondary framework sections 48,50 which, in turn, have mounted thereon, the major side wall bottom flap folding actuator mechanisms, as will be disclosed and discussed more fully hereinafter, and in this manner, the pair of oppositely disposed secondary framework sections 48,50 are movably mounted upon the primary framework 12 so as to be adjustable toward and away from each other in order to accommodate, and be operative in conjunction with, differently sized cases or cartons to be formed or erected.

Figure 2:
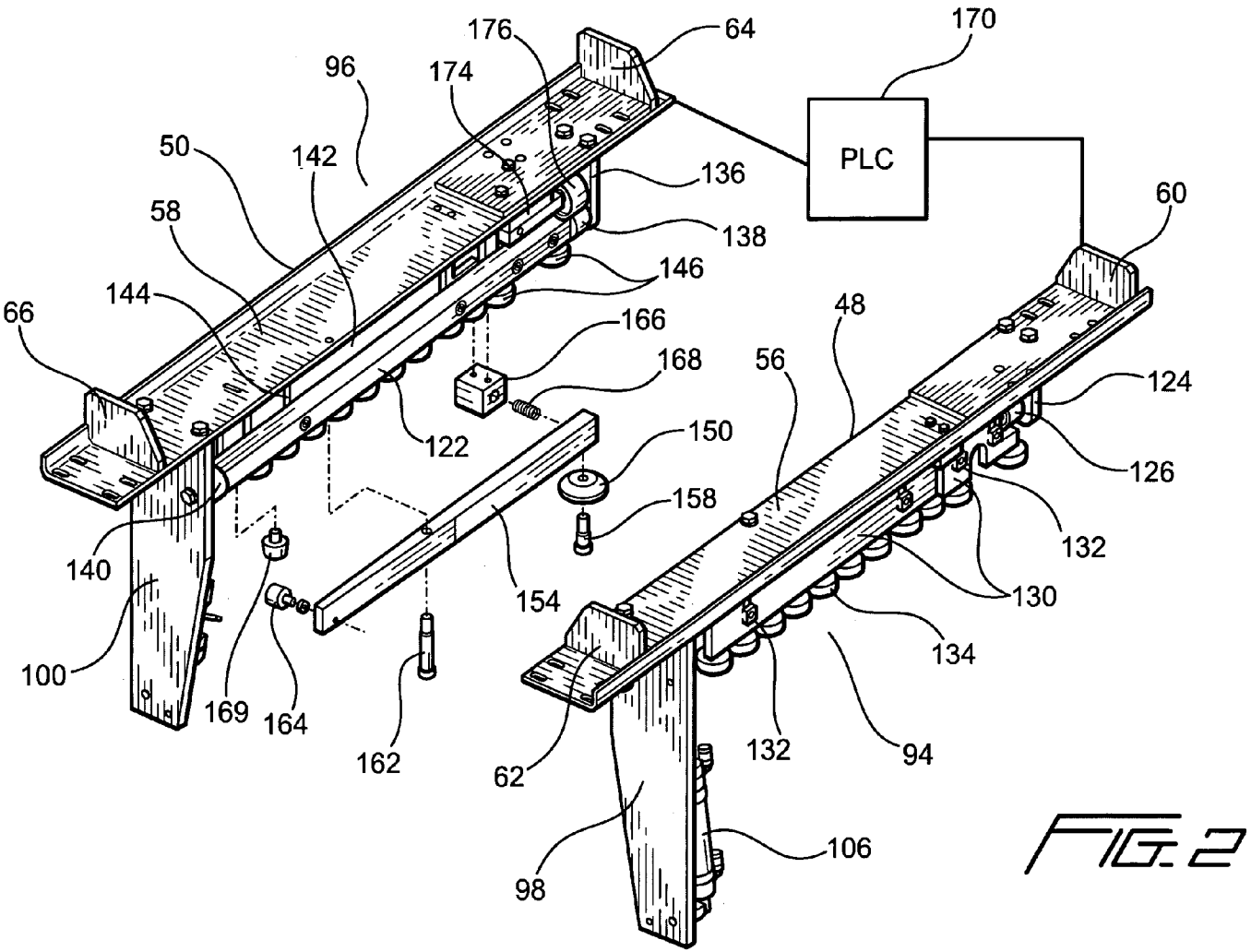
FIG. 2 is an exploded perspective view of the pair of oppositely disposed major side wall bottom flap folding actuators and the intercooperating pivotal roller mechanisms for engaging the pair of oppositely disposed major side wall members of the case or carton as the pair of oppositely disposed major side wall bottom flap members are being folded upwardly and inwardly by means of the pair of oppositely disposed major side wall bottom flap folding actuators.
Figure 3:
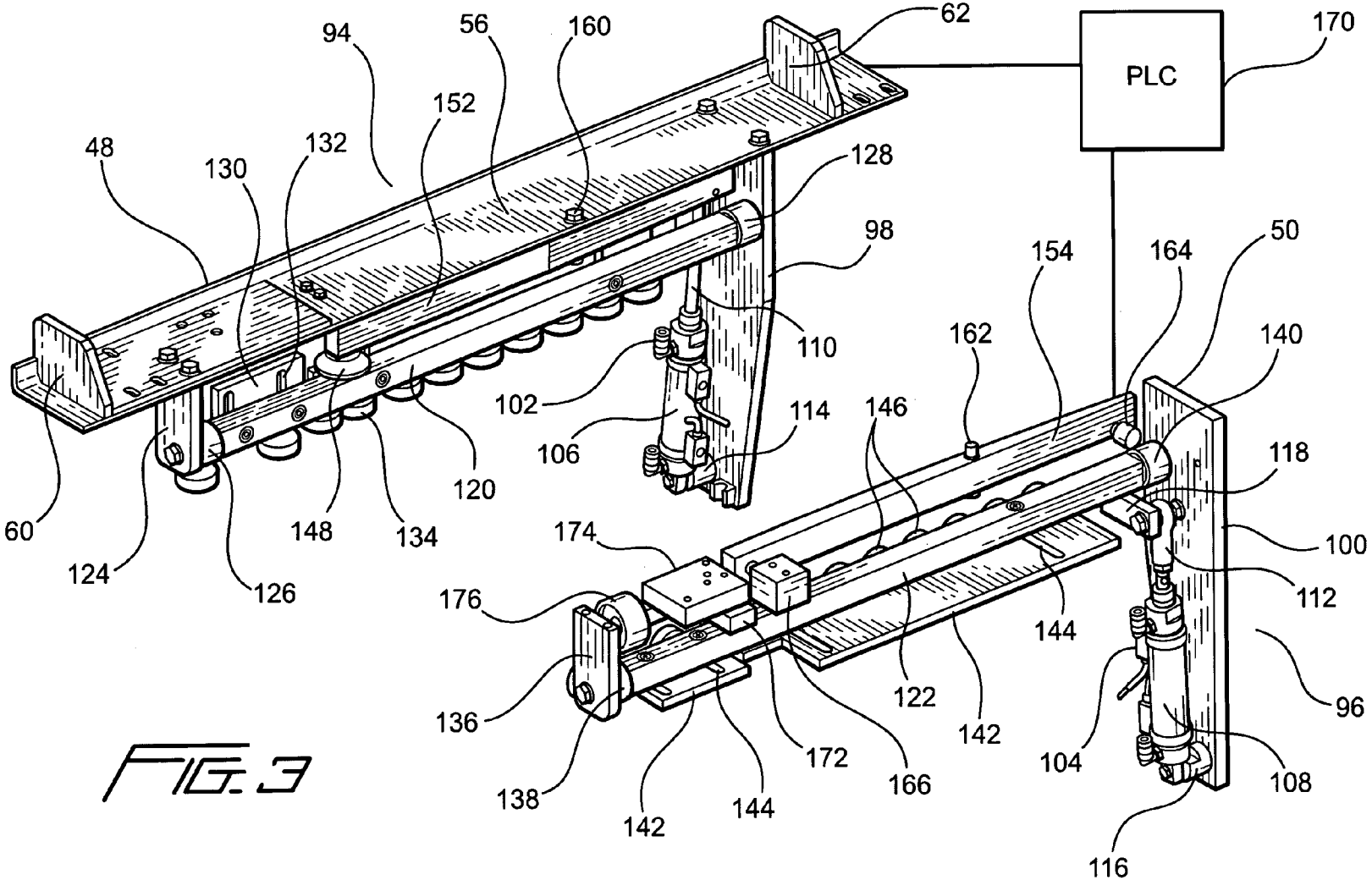
FIG. 3 is an exploded perspective view similar to that of FIG. 2 showing, however, the pair of oppositely disposed major side wall bottom flap folding actuators, and the intercooperating pivotal roller mechanisms for engaging the pair of oppositely disposed major side wall members of the case or carton as the pair of oppositely disposed major side wall bottom flap members are being folded upwardly and inwardly by means of the pair of oppositely disposed major side wall bottom flap folding actuators, from the opposite end perspective point so as to clearly show the details illustrating the piston-cylinder mechanisms for pivotally moving the pair of oppositely disposed major side wall bottom flap folding actuators and for interacting with the pivotal roller mechanisms which are adapted to engage the pair of oppositely disposed major side wall members of the case or carton.

More particularly, as can be further appreciated as a result of additional reference being made to FIGS. 2 and 3, each one of the nut members 44,46 is integrally provided with an upstanding mounting bracket 52,54, and the pair of oppositely disposed secondary framework sections 48,50 respectively comprise a pair of longitudinally extending support plates 56,58 which are adapted to be fixedly secured at opposite end portions thereof, by means of suitable bolt fasteners, not shown, atop the upstanding mounting brackets 52, 54 which are integral with the nut members 44,46. Each one of the longitudinally extending support plates 56,58 is provided with a pair of upstanding mounting brackets 60,62 and 64,66 adjacent the opposite ends thereof, and a pair of cap members 68,70, as disclosed within FIG. 1, are adapted to be respectively fixedly mounted upon the mounting brackets 60,62, and 64,66, of the longitudinally extending support plates 56,58. The upper internal portions of the cap members 68,70 are tapered or chamfered, as at 72,74, so as to effectively encounter and guide the pair of oppositely disposed, downwardly extending major side wall bottom flap members of the opened or expanded case or carton blank whereby the downward insertion of the opened or expanded case or carton blank into the case forming or erecting machine 10 is facilitated, and it will be further seen that the cap members 68,70 are respectively provided with dependent side walls or curtains 76,78 which serve to shield operator personnel from the movable components of the case forming or erecting machine 10.

Continuing further, with reference to FIG. 1, a pair of vertically oriented support rods 80 are respectively fixedly secured at the upper end portions thereof to undersurface portions of the support plate 56, and a support platform 82 is adjustably mounted upon the support rods 80 so as to accommodate different sized case or carton bottom flap members. In a similar manner, a pair of vertically oriented support rods 84 are respectively fixedly secured at the upper end portions thereof to undersurface portions of the support plate 56, and a support platform 86 is adjustably mounted upon the support rods 84. The platforms 82,86 are adapted to seat the lower edge portions of the oppositely disposed, downwardly extending major side wall bottom flap members of the opened or expanded case or carton blank when the case or carton blank is fully inserted into the case or carton forming or erecting machine 10, and limit switches, position switches, photodetectors, or the like, not shown, are operatively associated with each one of the platforms 82,86 so as to confirm the fact that the lower edge portions of the oppositely disposed, downwardly extending major side wall bottom flap members of the opened or expanded case or carton blank are in fact positioned or seated upon the platforms 82,86 in preparation for the commencement of a bottom flap member folding operation for forming the bottom wall portion of the case or carton.

A first pneumatically-powered minor end wall bottom flap member folding assembly 88 is fixedly mounted upon the lower transversely oriented cross-brace member 24 of the primary framework 12 for folding a first one of the minor end wall bottom flap members upwardly from its original vertically dependent position to a horizontal position at which it will partially form the bottom wall portion of the case or carton, and in a similar manner, a second pneumatically-powered minor end wall bottom flap member folding assembly 90 is fixedly mounted upon the lower transversely oriented cross-brace member 28 of the primary framework 12 for folding a second one of the minor end wall bottom flap members upwardly from its vertically dependent position to a horizontal position at which it will cooperate with the first one of the minor end wall bottom flap members so as to partially form the bottom wall portion of the case or carton. It is also noted that a pneumatically actuated finger mechanism is operatively mounted upon each one of the platforms 82,86, although only the finger mechanism operatively disposed upon platform 86 is visible as at 92. These finger mechanisms 92 are adapted to be actuated, just prior to the actuation of the first and second minor end wall bottom flap member folding assemblies 88,90, so as to effectively move the oppositely disposed first and second major side wall bottom flap members of the case or carton blank slightly outwardly from their normal vertically dependent positions so as to permit the first and second minor end wall bottom flap member folding assemblies 88,90 to in fact perform their folding operations, with respect to the oppositely disposed minor end wall bottom flap members, whereby the oppositely disposed minor end wall bottom flap members will be able to be moved upwardly and inwardly in an unobstructed manner.

With reference again being made primarily to FIGS. 2 and 3, the first and second major side wall bottom flap member folding assemblies 94,96, for folding the first and second oppositely disposed major side wall bottom flap members of the case or carton blank upwardly and inwardly in order to cooperate with the previously folded first and second oppositely disposed minor end wall bottom flap members of the case or carton blank is order to complete the formation of the bottom wall portion of the case or carton, will now be described. More particularly, each one of the first and second major side wall bottom flap member folding assemblies 94, 96 is seen to comprise a vertically oriented mounting plate 98,100 upon which is pivotally mounted a piston-cylinder assembly 102,104, and each one of the piston-cylinder assemblies 102,104 is seen to comprise a cylinder 106,108 and a piston rod 110,112. The lower end of each cylinder 106,108 is mounted upon a bearing member 114,116, and the upper yoked end of each piston rod 110,112 is pivotally connected to a crank arm, only one of which is visible in FIG. 3 at 118, which, in turn, are respectively fixedly connected to a support arm 120,122. A dependent mounting bracket 124 is adapted to be fixedly secured to the undersurface of the support plate 56, and one end of the support arm 120 is pivotally mounted upon the mounting bracket 124 through means of a first bearing member 126, while the opposite end of the support arm 120 is pivotally mounted upon the vertically oriented mounting plate 98 through means of a second bearing member 128. Roller mounting plates 130 are adjustably mounted upon the support arm 120 by means of suitable bolt and slot assemblies 132, and a longitudinal array of rollers 134 are rotatably mounted upon the roller mounting plates 130.

In a similar manner, a dependent mounting bracket 136 is adapted to be fixedly secured to the undersurface of the support plate 58, and one end of the support arm 122 is pivotally mounted upon the mounting bracket 136 through means of a third bearing member 138, while the opposite end of the support arm 122 is pivotally mounted upon the vertically oriented mounting plate 100 through means of a fourth bearing member 140. Roller mounting plates 142 are adjustably mounted upon the support arm 122 by means of suitable bolt and slot assemblies 144, and a longitudinal array of rollers 146 are rotatably mounted upon the roller mounting plates 142. It can therefore be appreciated that when the piston-cylinder assemblies 102,104 are actuated such that each one of the piston rods 110,112 are respectively disposed at their extended positions, as exemplified by means of the piston-cylinder assembly 102 as illustrated within FIG. 3, the piston rods 110,112 will cause the support arms 120,122 to rotate around the longitudinal axes defined between the bearing members 126,128 and 138,140, through means of the cranks arms 118, such that the rollers 134,146 will be disposed in their retracted positions with the peripheral surface portions of the rollers 134,146 being disposed within horizontal planes as exemplified by means of the array of rollers 134 as illustrated within FIG. 3.

To the contrary, when the piston-cylinder assemblies 102,104 are actuated such that each one of the piston rods 110,112 are respectively disposed at their retracted positions, as exemplified by means of the piston-cylinder assembly 104 as illustrated within FIG. 3, the piston rods 110,112 will cause the support arms 120,122 to rotate around the longitudinal axes defined between the bearing members 126,128 and 138,140, through means of the cranks arms 118, such that the rollers 134,146 will be disposed in their extended positions with the peripheral surface portions of the rollers 134,146 being disposed within vertical planes as exemplified by means of the array of rollers 146 as illustrated within FIG. 3. It can therefore be appreciated later, when both of the arrays of rollers 134,146 are pivotally rotated through an arcuate extent of 90° so as to be moved from their retracted positions, as exemplified by means of the rollers 134 as illustrated within FIG. 3, to their extended positions, as exemplified by means of the rollers 146 as illustrated within FIG. 3, the oppositely disposed arrays of rollers 134,146 will contact the first and second oppositely disposed major side wall bottom flap members of the case or carton blank, the oppositely disposed arrays of rollers 134, 146 will then cause the first and second oppositely disposed major side wall bottom flap members of the case or carton blank to be moved upwardly and inwardly to their horizontally oriented folded positions in order to cooperate with the previously folded first and second oppositely disposed minor end wall bottom flap members of the case or carton blank so as to complete the formation of the bottom wall portion of the case or carton, and still further, the oppositely disposed arrays of rollers 134,146, being disposed within their vertically oriented planes, will now effectively define a roller conveyor floor mechanism upon which the case or carton is supported in position so as to now be filled with product and will subsequently be able to be easily discharged from the case or carton forming or erecting machine 10 so as to be conducted toward a sealing machine or the like.

Continuing further, and in accordance with another unique and novel feature of the present invention, it will be recalled that when the oppositely disposed arrays of rollers 134,146 are pivotally moved into contact with the first and second oppositely disposed major side wall bottom flap members of the case or carton blank so as to cause the first and second oppositely disposed major side wall bottom flap members of the case or carton blank to be moved upwardly and inwardly to their folded positions in order to cooperate with the previously folded first and second oppositely disposed minor end wall bottom flap members of the case or carton blank so as to complete the formation of the bottom wall portion of the case or carton, it is desired to firmly contact or engage the oppositely disposed major side wall members of the case or carton so as to effectively fixedly secure the case or carton upon the arrays of rollers 134,146 in preparation for performing the product filling operation. Accordingly, it will be further appreciated that a pair of engagement rollers 148,150 are respectively mounted upon first end portions of a pair of roller support arms 152,154 by means of suitable bolt members, only one of which is visible at 158, and that the roller support arms 152,154 are respectively mounted, at substantially central regions thereof, beneath the support plates 56,58 by means of pivot pins 160,162 whereby the roller support arms 152,154 are pivotally movable with respect to the support plates 56,58 around vertically oriented axes defined by means of the pivot pins 160,162.

Continuing still further, and with reference still being made to FIGS. 2 and 3, bumper members are adapted to be fixedly mounted upon the second opposite ends of the roller support arms 152,154, although only the bumper member 164 which is fixedly mounted upon the roller support arm 154 is visible in the drawings, and in addition, a spring mounting block 166, within which there is disposed a coil spring 168, is adapted to be fixedly mounted upon the undersurface portion of the support plate 58, it being realized that a similar spring mounting block and coil spring are likewise mounted upon the undersurface portion of the support plate 56, however, such components are not visible in the drawings. It is also to be appreciated that when the piston rods 110,112 of the piston-cylinder assemblies 102, 104 are disposed at their extended positions, as illustrated within FIG. 3 in connection with the major side wall bottom flap member folding assembly 94, the roller mounting plates 130,142 will be disposed within vertical planes, and the arrays of rollers 134,146 will be disposed at their retracted states and within horizontally oriented planes. In addition, the upper yoke end portions of the piston rods 110,112 will be disposed in contact with the bumper members 164 so as to cause the second end portions of the roller support arms 152,154 to be forced inwardly toward the interior region of the case or carton forming or erecting machine 10, while conversely, the first end portions of the roller support arms 152,154, upon which the engagement rollers 148,150 are mounted, will be forced outwardly away from the interior region of the case or carton forming or erecting machine 10, and against the biasing forces of the coil springs 168, as a result of the pivotal movement of the roller support arms 152,154 about their respective pivot pins 160,162.

Conversely, when the piston rods 110,112 of the piston-cylinder assemblies 102,104 are moved toward their retracted positions, as illustrated within FIG. 3 in connection with the major side wall bottom flap member folding assembly 96, the roller mounting plates 130,142 will be moved toward their dispositions within horizontal planes whereby the arrays of rollers 134,146 will be arcuately moved toward their extended states within vertically oriented planes so as to cause the major side wall bottom flap members to be folded upwardly and inwardly to their folded positions at which they complete the formation of the bottom wall portion of the case or carton. In addition, the upper yoke end portions of the piston rods 110,112 will have been moved away from the bumper members 164 so as to no longer be disposed in contact with the bumper members 164 whereby the second end portions of the roller support arms 152,154 can now move outwardly away from the interior region of the case or carton forming or erecting machine 10 as a result of the first end portions of the roller support arms 152,154 being forced to move toward the interior region of the case or carton forming or erecting machine under the influence of the biasing forces of the coil springs 168. In this manner, the engagement rollers 148,150 will engage the major side wall members of the case or carton so as to fixedly retain the case or carton upon the arrays of roller 134,146. Rubber bumper members 169 are also mounted upon the undersurface portions of the support plates 56,58 so as to engage the second end portions of the roller support arms 152,154 so as to prevent the same from moving too far away from the interior region of the case or carton forming or erecting machine 10 which would permit the coil springs 168 to become dislodged from their dispositions within the coil spring mounts 166.

It is lastly noted that in connection with the actual operation of the new and improved case or carton forming or erecting machine 10 of the present invention, that the various moving or actuating components of the case or carton forming or erecting machine 10, such as, for example, the first and second pneumatically-powered minor end wall bottom flap member folding assemblies 88,90, the first and second piston-cylinder assemblies 102,104 for controlling the first and second arrays of rollers 134,146 for folding the first and second major side wall bottom flap members of the case or carton blank, and the first and second pneumatically-controlled finger mechanisms 92 for moving the first and second major side wall bottom flap members slightly outwardly prior to the actuation of the first and second pneumatically-powered minor end wall bottom flap member folding assemblies 88,90 such that the upward and inward folding of the first and second minor end wall bottom flap members will occur without encountering any interference, are under the control of a programmable logic controller (PLC) 170. It is additionally noted that, in order to commence a case or carton forming or erecting operation, a plunger switch mechanism 172 is mounted upon a plunger switch mounting block 174 which is secured to an undersurface portion of the support plate 58, and a roller actuator 176 is operatively connected to the plunger switch mechanism 172.

In this manner, when the case or carton blank is inserted downwardly into the interior of the case or carton forming or erecting machine 10, one of the major side wall bottom flap members of the case or carton blank will engage the roller actuator 176 so as to cause the same to move inwardly and thereby activate the plunger switch mechanism 172. The plunger switch mechanism 172 will transmit a control signal to the programmable logic controller (PLC) 170, and it will also be recalled that suitable limit switches, position switches, photodetectors, or the like, not shown, are operatively associated with each one of the platforms 82,86 so as to confirm the fact that the lower edge portions of the oppositely disposed, downwardly extending major side wall bottom flap members of the opened or expanded case or carton blank are in fact positioned or seated upon the platforms 82,86 in preparation for the commencement of a bottom flap member folding operation for forming the bottom wall portion of the case or carton. Accordingly, when such limit switches, position switches, photodetectors, or the like, not shown, likewise transmit their confirmation signals to the programmable logic controller (PLC) 170, the programmable logic controller (PLC) 170 will commence a folding operation for folding the oppositely disposed minor end wall bottom flap members, and the oppositely disposed major side wall bottom flap members, of the case or carton blank upwardly and inwardly so as to in fact form the bottom wall portion of the case or carton.

It will be recalled that when the arrays of rollers 134,146 have been moved to their extended positions as illustrated within FIG. 3 in connection with the framework section 50, the arrays of rollers 134,146 will have effectively formed a floor or support platform upon which the formed or erected case or carton is supported during the product filling stage, and it is noted that the case or carton will, at this point in time, be disposed at an elevational level which enables the filled case or carton to be discharged from the case or carton forming or erecting machine 10 so as to be conducted toward, for example, case or carton sealing apparatus. In order to facilitate the discharge of the filled case or carton from the case or carton forming or erecting machine 10, it is lastly noted that a plurality of discharge rollers 178 are suitably mounted upon the upper cross-brace member 22 of the primary framework 12, so as to be disposed, in effect, in a coplanar manner with the arrays of rollers 134,146 which have formed the underlying floor or platform structure for the formed or erected case or carton, as is disclosed within FIG. 1. As is the case with the arrays of rollers 134,146, the discharge rollers 178 may be idler rollers, and need not be powered, whereby the completed case or carton can be manually discharged from the case or carton forming or erecting machine 10. A slotted guide member 179, in the form of a leaf spring type structure, is also operatively associated with the discharge rollers 178 so as to effectively guide the case or carton onto the discharge rollers 178, as well as to permit a portion of the minor end wall bottom flap member folding assembly 88 to pass upwardly within the slotted portion thereof.

Thus, it may be seen that in accordance with the principles and teachings of the present invention, there has been disclosed a new and improved case former, or carton folding and erecting apparatus, wherein a pair of pivotal support arms, upon each one of which is mounted a case or carton engagement roller, are mounted upon the machine framework such that when actuator mechanisms, for folding the oppositely disposed major side bottom flap members of the case or carton to their folded positions so as to complete the formation of the bottom portion of the case or carton, are actuated, the pair of pivotal support arms are effectively released from a restrained position, at which the case or carton engagement rollers are disposed at retracted positions with respect to the case or carton blank so as to initially permit the case or carton blank to be inserted into the case former, or carton folding and erecting apparatus, in an unobstructed manner, whereby the case or carton engagement rollers can now engage the major side walls of the case or carton so as to retain the case or carton in position while the case or carton is subsequently filled with product. Upon completion of the case or carton filling process, the case or carton can be discharged from the machine so as to be conducted into a case sealer machine.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. Apparatus for engaging at least one of the pairs of oppositely disposed major side wall members of a case blank so as to fixedly secure the case blank within said apparatus while a bottom wall member of a case is being formed by folding a pair of oppositely disposed minor end wall bottom flap members and a pair of oppositely disposed major side wall bottom flap members upwardly and inwardly, comprising:

frame members defining a space therebetween within which a case blank is to be disposed so as to have a bottom wall member formed thereon from a pair of oppositely disposed minor end wall bottom flap members and a pair of oppositely disposed major side wall bottom flap members;

means mounted upon said frame members for folding the pair of oppositely disposed minor end wall bottom flap members and the pair of oppositely disposed major side wall bottom flap members upwardly and inwardly so as to form a part of the bottom wall member of the case; and engagement means movably mounted upon said frame members, independent of said means for folding the pair of oppositely disposed major side wall bottom flap members, between a retracted position at which said engagement means will be located away from said space so as to permit the case blank to be inserted into said space defined between said frame members, and an extended position at which said engagement means will project into said space defined between said frame members so as to engage at least one of the pairs of oppositely disposed major side wall members of the case blank so as to fixedly secure the case blank within said space defined between said frame members while the bottom wall member of the case is formed by folding the pair of oppositely disposed minor end wall bottom flap members and the pair of oppositely disposed major side wall bottom flap members upwardly and inwardly.

2. The apparatus as set forth in claim 1, wherein:

said engagement means comprises a pair of engagement rollers.

3. The apparatus as set forth in claim 2, wherein:

said engagement means comprises a pair of support arms which are pivotally mounted upon said frame members, and which have said pair of engagement rollers mounted thereon.

4. The apparatus as set forth in claim 1, wherein:

said means, mounted upon said frame members for folding the pairs of oppositely disposed major side wall bottom flap members upwardly and inwardly, comprises a pair of roller arrays which are pivotally movable between a retracted position at which said pair of roller arrays are disengaged from the oppositely disposed major side wall bottom flap members, and an extended position at which said pair of roller arrays are engaged with the pair of oppositely disposed major side wall bottom flap members, so as to fold the pair of oppositely disposed major side wall bottom flap members upwardly and inwardly so as to thereby form a part of the bottom wall member of the case, and wherein further, said pair of roller arrays together form a roller conveyor upon which the case is supported.

5. The apparatus as set forth in claim 4, further comprising:

actuating means for moving said pair of roller arrays between said retracted and extended positions.

6. The apparatus as set forth in claim 5, wherein:

said actuating means are respectively engageable with said pair of support arms upon which said pair of engagement rollers are mounted such that when said pair of roller arrays are disposed at said retracted positions, said engagement rollers will be disposed at said retracted positions, and when said pair of roller arrays are disposed at said extended positions, said engagement rollers will be disposed at said extended positions.

7. A case forming machine for forming a bottom wall member of a case from a case blank comprising a pair of oppositely disposed minor end wall members, a pair of oppositely disposed major side wall members, a pair of oppositely disposed minor end wall bottom flap members, and a pair of oppositely disposed major side wall bottom flap members, comprising:

a framework defining an interior region within which a case blank is to be disposed so as to have a bottom wall member formed thereon from a pair of oppositely disposed minor end wall bottom flap members and a pair of oppositely disposed major side wall bottom flap members;

first means mounted upon said framework for folding the pair of oppositely disposed minor end wall bottom flap members upwardly and inwardly so as to partially form the bottom wall member of the case;

second means mounted upon said framework for folding the pair of oppositely disposed major side wall bottom flap members upwardly and inwardly so as to complete the formation of the bottom wall member of the case; and engagement means movably mounted upon said framework, independent of said first and second means for folding the pair of oppositely disposed minor end wall bottom flap members and the pair of oppositely disposed major side wall bottom flap members, between a retracted position at which said engagement means will be located away from said interior region of said framework so as to permit the case blank to be inserted into said interior region of said framework, and an extended position at which said engagement means will project into said interior region of said framework so as to engage at least one of the pairs of oppositely disposed major side wall members of the case so as to fixedly secure the case blank within said interior region of the framework while the bottom wall member of the case is being formed by folding the pair of oppositely disposed minor end wall bottom flap members and the pair of oppositely disposed major side wall bottom flap members upwardly and inwardly.

8. The machine as set forth in claim 7, wherein:

said engagement means comprises a pair of engagement rollers.

9. The machine as set forth in claim 8, wherein:

said engagement means comprises a pair of support arms which are pivotally mounted upon said frame members, and which have said pair of engagement rollers mounted thereon.

10. The machine as set forth in claim 7, wherein:

one of said first and second means mounted upon said frame members for folding one of the pairs of oppositely disposed minor end wall bottom flap members and the oppositely disposed major side wall bottom flap members upwardly and inwardly, comprises a pair of roller arrays which are pivotally movable between a retracted position at which said pair of roller arrays are disengaged from one of the pairs of oppositely disposed minor end wall bottom flap members and oppositely disposed major side wall bottom flap members, and an extended position at which said pair of roller arrays are engaged with one of the pairs of oppositely disposed minor end wall bottom flap members and the oppositely disposed major side wall bottom flap members, so as to fold one of the pairs of oppositely disposed minor end wall bottom flap members and the oppositely disposed major side wall bottom flap members upwardly and inwardly so as to thereby form a part of the bottom wall member of the case, and wherein further, said pair of roller arrays together form a roller conveyor upon which the case is supported.

11. The machine as set forth in claim 10, further comprising:

actuating means for moving said pair of roller arrays between said retracted and extended positions.

12. The machine as set forth in claim 11, wherein:

said actuating means are respectively engageable with said pair of support arms upon which said pair of engagement rollers are mounted such that when said pair of roller arrays are disposed at said retracted positions, said engagement rollers will be disposed at said retracted positions, and when said pair of roller arrays are disposed at said extended positions, said engagement rollers will be disposed at said extended positions.

13. The machine as set forth in claim 11, wherein:

said actuating means comprises pneumatic pistoncylinder assemblies; and programmable logic control means are mounted upon said framework for controlling said piston-cylinder assemblies.

14. In combination, a case blank, and a case forming machine for forming a bottom wall member of a case from the case blank, comprising:

a case blank comprising a pair of oppositely disposed minor end wall members, a pair of oppositely disposed major side wall members, a pair of oppositely disposed minor end wall bottom flap members, and a pair of oppositely disposed major side wall bottom flap members; and a case forming machine comprising a framework defining an interior region within which a case blank is to be disposed so as to have a bottom wall member formed thereon from a pair of oppositely disposed minor end wall bottom flap members and a pair of oppositely disposed major side wall bottom flap members; first means mounted upon said framework for folding the pair of oppositely disposed minor end wall bottom flap members upwardly and inwardly so as to partially form the bottom wall member of the case; second means mounted upon said framework for folding the pair of oppositely disposed major side wall bottom flap members upwardly and inwardly so as to complete the formation of the bottom wall member of the case; and engagement means movably mounted upon said framework, independent of said first and second means for folding the pair of oppositely disposed minor end wall bottom flap members and the pair of oppositely disposed major side wall bottom flap members, between a retracted position at which said engagement means will be located away from said interior region of said framework so as to permit the case blank to be inserted into said interior region of said framework, and an extended position at which said engagement means will project into said interior region of said framework so as to engage at least one of the pairs of oppositely disposed major side wall members of the case so as to fixedly secure the case blank within said interior region of the framework while the bottom wall member of the case is being formed by folding the pair of oppositely disposed minor end wall bottom flap members and the pair of oppositely disposed major side wall bottom flap members upwardly and inwardly.

15. The combination as set forth in claim 14, wherein:

said engagement means comprises a pair of engagement rollers.

16. The combination as set forth in claim 15, wherein:

said engagement means comprises a pair of support arms which are pivotally mounted upon said frame members, and which have said pair of engagement rollers mounted thereon.

17. The combination as set forth in claim 14, wherein:

one of said first and second means mounted upon said frame members for folding one of said pairs of oppositely disposed minor end wall bottom flap members and said oppositely disposed major side wall bottom flap members upwardly and inwardly, comprises a pair of roller arrays which are pivotally movable between a retracted position at which said pair of roller arrays are disengaged from said one of said pairs of oppositely disposed minor end wall bottom flap members and said oppositely disposed major side wall bottom flap members, and an extended position at which said pair of roller arrays are engaged with one of said pairs of oppositely disposed minor end wall bottom flap members and said oppositely disposed major side wall bottom flap members, so as to fold said one of said pairs of oppositely disposed minor end wall bottom flap members and said pair of oppositely disposed major side wall bottom flap members upwardly and inwardly so as to thereby form a part of said bottom wall member of said case, and wherein further, said pair of roller arrays together form a roller conveyor upon which said case is supported.

18. The combination as set forth in claim 17, further comprising:

actuating means for moving said pair of roller arrays between said retracted and extended positions.

19. The combination as set forth in claim 18, wherein:

said actuating means are respectively engageable with said pair of support arms upon which said pair of engagement rollers are mounted such that when said pair of roller arrays are disposed at said retracted positions, said engagement rollers will be disposed at said retracted positions, and when said pair of roller arrays are disposed at said extended positions, said engagement rollers will be disposed at said extended positions.

20. The combination as set forth in claim 18, wherein:

said actuating means comprises pneumatic pistoncylinder assemblies; and programmable logic control means are mounted upon said framework for controlling said piston-cylinder assemblies.

* * * * *